US007509936B2

(12) United States Patent
Weinzierl et al.

(10) Patent No.: US 7,509,936 B2
(45) Date of Patent: Mar. 31, 2009

(54) ENGINE WITH HYBRID CRANKCASE

(75) Inventors: Steven M. Weinzierl, New Richmond, WI (US); Michael J. Fuchs, New Richmond, WI (US)

(73) Assignee: Engineered Propulsion Systems, Inc., New Richmond, WI (US)

( * ) Notice: Subject to any disclaimer, the term of this patent is extended or adjusted under 35 U.S.C. 154(b) by 0 days.

(21) Appl. No.: 11/879,011

(22) Filed: Jul. 13, 2007

(65) Prior Publication Data

US 2008/0022963 A1 Jan. 31, 2008

Related U.S. Application Data

(60) Provisional application No. 60/831,262, filed on Jul. 14, 2006.

(51) Int. Cl.
*F02F 7/00* (2006.01)

(52) U.S. Cl. ..... 123/195 C; 123/195 R

(58) Field of Classification Search ..... 123/195 R, 123/193.1, 193.2, 195 H, 41.74, 195 C; 29/888.06, 29/888.061

See application file for complete search history.

(56) References Cited

U.S. PATENT DOCUMENTS

| | | | | |
|---|---|---|---|---|
| 5,562,073 | A * | 10/1996 | Van Bezeij et al. | 123/193.2 |
| 6,192,852 | B1 | 2/2001 | Gerhards et al. | |
| 6,253,725 | B1 | 7/2001 | Groddeck et al. | |
| 6,349,681 | B1 * | 2/2002 | Li | 123/41.74 |
| 6,647,944 | B2 * | 11/2003 | Kamiya | 123/195 R |
| 7,191,742 | B2 | 3/2007 | Fuchs et al. | |
| 2008/0022963 | A1 | 1/2008 | Weinzierl et al. | |

* cited by examiner

*Primary Examiner*—Michael Cuff
*Assistant Examiner*—Hyder Ali
(74) *Attorney, Agent, or Firm*—Patterson, Thuente, Skaar & Christensen, P.A.

(57) ABSTRACT

An engine with a hybrid crankcase includes the crankcase being a composite construction having an exoskeleton formed of a non-ferrite material having no defined endurance limit as a material, the non-ferrite exoskeleton encapsulating a load bearing skeleton formed of a ferrite material, the ferrite material having a well defined endurance limit, whereby the skeleton acts to carry the highest engine loadings. A method of forming such an engine is further included.

18 Claims, 15 Drawing Sheets

ENGINE WITH HYBRID CRANKCASE

RELATED APPLICATIONS

The present application claims the benefit of U.S. Provisional Application 60/831262, filed Jul. 14, 2006 and incorporated herein in its entirety by reference.

TECHNICAL FIELD

The present application is drawn to an internal combustion engine. More particularly, the present application is drawn to an internal combustion engine having a crankcase formed of differing metallic components.

BACKGROUND OF THE INVENTION

In the recent past, automotive engine designers have focused their efforts on engine down-sizing activities. The goal of the automotive engine engineer has been to increase engine performance of smaller displacement engines to allow them to be competitive with their larger displacement (heavier) counterparts. This has been done for the purpose of enhancing fuel economy by reducing overall vehicle weight. As a result, the engine performance of engines has risen to the extent that the engine block has become a more highly-stressed component, and the subject of much debate. This is particularly true of the present class of highly efficient European passenger car turbo-diesel engines. These engines have attained peak cylinder pressures approaching 200 bar, which has stressed the engine block far beyond historical levels. See Prior art FIG. 1.

For years the only cost effective material of choice for automotive engine block construction was gray cast iron. This material was used for its ability to be designed with for "infinite life" due to the nature of iron-based crystalline structures (body centered cubic crystalline structures). The material provided a good tradeoff for initial cost and machineability. The cost of automotive engine blocks was reasonable, and the engine could be easily re-built by renewing the engine and/or crankshaft bearing bores, and installing an over-sized piston.

As weight became more of an issue for automobile designers, we began to see more aluminum block concepts find their way into production. The trend began as a way to save weight in performance applications, but since has been used in all types of vehicles to reduce weight and hence rolling friction, and provide superior fuel economy.

Any piston engine is simply a collection of pressure vessels that utilizes a crank rocker (crankshaft) mechanism to impart the expansion work of gases for the purpose of delivering useful work. See Prior art FIG. 4. The challenge to engine designers has always been to develop an elegant structure that uses no more material than necessary to deliver reliable power. With recent advances in diesel technology, the necessity to optimize engine block and crank shaft design has become evident. Modem diesel engine combustion creates peak gas forces in the region of 200 bars peak pressure. (See Prior Art FIG. 3) This is more than twice the pressure of a typical gasoline automotive engine, and 3-4 times that seen in aircraft engines. The two most massive engine components by weight have traditionally been the engine block and crankshaft assembly.

Although it is well known by engineers that modem diesel engines are more thermally efficient, the challenge for weight-sensitive applications has been to integrate diesels into a compact weight-efficient package. Nowhere is this more critical than in the design of aero applications. This application demands that an engine be lightweight, durable, efficient and powerful. To achieve these characteristics simultaneously, the engineer must go through a thorough a "sizing" study to determine how much engine capacity is sufficient to do the job properly.

Brake Mean Effective Pressure (BMEP), or P in Equation 1, is used to compare the performance of various engine configurations. It is the average pressure over the cycle time that an engine would achieve if it were operating as a constant pressure device.

The basic equation for engine power can be simplified to the following form:

$$\text{Power}=PLAN$$

Equation 1 Definition of Power as a Function of BMEP, Engine Geometry, and Speed Where:

P=Average Pressure on the Piston

L=Stroke Length

A=Piston Area

N=Firing Pulses per Minute

It should be evident then that given the same power target, the options are limited for the engine designer. It should also be evident that the only way to increase power output of a four-stroke engine is to:

1. Increase capacity; (engine displacement by increasing a combination of L & A)
2. Increase engine speed; (firing pulses per unit time)
3. Increase P; (the average pressure over the cycle)

Since the goal is to obtain more specific power, the task of the engine designer is to increase power without a corresponding increase in weight. The significance of this is that by definition, an increase in engine volume will result in an increase in weight. This effectively eliminates option "1" above.

To increase engine speed would certainly result in an increase in specific power. However, this is generally contradictory to engine durability. Things like bearing loading, piston speed, and dynamic vibrations are generally increased with engine speed. A gear reduction can be used to provide torque multiplication when the torque capacity of an engine is insufficient. This is not without penalty, as the design must consider the tradeoff between engine displacement, and gear reduction weight. Another consideration is the gear efficiency (sound characteristic) and torsional behavior of such a gear reduction.

An additional element to consider with regard to increasing engine speed is hat the dimensional accuracy of the engine machined components must be increased to ensure proper dynamic engine behavior. This fact translates directly to increased manufacturing costs which certainly must be taken into consideration in the construction of a light-weight, high speed engine.

So, the last parameter that is increased in the power equation becomes the mean pressure over the cycle duration. In gasoline and diesel engines the use of supercharging has achieved this effect. The peak cylinder pressure has also been practically raised until the limitations on engine block materials have been pushed to their physical limits. In extreme cases, cast iron cylinder heads, or steel inserted heads are being put into production to meet the demands of these high pressure diesel engines.

High pressure simply translates to high component stress in many aspects of the design. The higher stress means that we have to more carefully pursue the effective use of materials to ensure an efficient design.

The limitations of an engine design are typically those imposed by the selected materials of construction. The properties of any given material are readily tested in the usual methods such as the tension test to identify a materials' strength or the rotating beam which is utilized to test the resistance of a material to fatigue, endurance limit, over many cycles.

The most basic difference is the lack of an endurance limit for aluminum materials and their alloys. (Incidentally, practical experience of the applicants (confirmed by written literature and in foundry discussions) limits peak low-silicon aluminum block stress to values less than 200 $N/mm^2$ and hyper-eutectic aluminum peak stress to under 50 $N/mm^2$, to prevent fatigue cracking over the design life of an automotive engine.) See Prior art FIG. 5. In general, all materials are more sensitive to torsional loading than pure tension loading, and are the least sensitive to compressive stress.

Virtually all material properties degrade with temperature. (See Prior Art FIG. 6) This degradation of material properties is why engine designers' strive to optimize engine cooling systems to ensure that engine durability is achieved in the highest temperature service. It has long been known that the dimensions of an engine can be distorted due to the loads imposed on an engine. This distortion is the source for much of the friction and additional loads present in a running engine in service. In fact, at the highest level of motor-sport competition, engine bores are machined with the engine pre-heated and pre-stressed to the running conditions in service.

In a more conventional sense, the thermal growth can be controlled by the appropriate selection of materials. For example, it is usual practice to select steel and cast iron for crankshaft and engine block materials since they have similar values of thermal expansion. By "matching" materials the engine engineer can assure that sensitive bearing clearances will be maintained at both elevated and reduced temperatures. This allows the bearings to maintain consistent clearance, and perform to their optimal design.

Referring to Prior Art FIG. 7, it is well known that aluminum engines lose clamping tension at low temperatures, and reduce main bearing clearance from the differential shrinkage of the aluminum block and crankshaft. This is detrimental to the life of the engine bearing shells, since most engine damage is likely to occur in cold starts.

Conversely, in "hot running conditions" the bearing clearance in an aluminum block can be so large as to lose the stability of the oil film by excessive side-leakage which can also cause engine bearing damage.

Recently, the aluminum block has begun to surface in passenger car diesels that are a large part of the European market. With fuel economy being a primary focus of this application, weight has become an important factor in the decision matrix. When the duty cycle of a passenger car is considered, the durability of the car engine is not a primary driver for the design. Most automotive applications must endure 500 hours of durability testing, or less depending on the severity of the test cycle, and are not traditionally rebuilt at the end of their service life. In fact, there has been some recent discoveries that the most highly-loaded fastener threads (i.e. cylinder head, main bearing caps) have fatigued to the point that the engine is not serviceable. (See Prior Art FIG. 8).

The decision to select a material need not be an exclusive one. The concept of reinforcement has been used for centuries in concrete construction etc. In fact, the selection of various materials is demonstrated in several production engine blocks. For example, whenever aluminum is used for its high strength/weight ratio as the primary structure of an engine, a secondary treatment such as Mahle's Nikasil® is used in the high wear cylinder bore area. In this way, we have a truly composite structure comprised of aluminum for the frame of the engine, and Nikasil® as the micro-thin bore. This is depicted in Prior Art FIG. 9.

When weight is of primary concern, new materials of construction have recently surfaced. For example, BMW has led the way with the utilization of magnesium as a block structure, and hypereutectic aluminum as the running surface of the cylinder bores.

Hyper-eutectic aluminum is a material that can have silicon content as high as 19%, which allows pistons to run directly on the bore surface without a hardening treatment of the bores. Plasma spaying has also been experimented with in conjunction with chemical and laser etching to achieve a proper surface for oil film formation. See Prior Art FIG. 10.

Other concepts are using mechanically reinforced aluminum engine structures, such as BMW's steel-reinforced aluminum block shown in Prior Art FIG. 11. This system achieves reinforcement through bolt-on steel sections, and optimization of bearing cap features.

Audi and Ford have recently used enhancement of traditional materials like cast irons to minimize weight while retaining the durability characteristics expected of a modem automotive engine. One such material is compacted graphite iron, which is a specialized form of cast iron pioneered by the Sintercast™ company of Sweden.

Audi has made the decision to go with a "modified" case iron known as compacted graphite iron or CGI. The cast iron utilizes proprietary techniques to alter the material on a molecular level to ensure optimum strength in thin sections. The benefits of this material have focused the engineering effort at Audi on the full "optimization" of the engine block, making use of the minimum material necessary to achieve strength, retain bore roundness, and reduce the emitted sound from the structure. This block is depicted in Prior Art FIG. 12.

SUMMARY OF THE INVENTION

As depicted in FIG. 2, the applicants have designed an engine block construction that allows the diesel engine to be weight effective in aircraft applications which are traditionally the most challenging in terms of weight and reliability with their high duty-cycle. Aircraft engines for example, have traditionally been constructed of aluminum, which is susceptible to cracking over time, due to the nature of the aluminum material crystalline structure. The goal of the applicants in their engine block design concept was to retain the positive features of each construction and arrive at an engine block that is a true "hybrid" of the most widely used materials in engine design.

Successful engine designs consider the intent of the engine in the role it must fulfill during its life cycle. The decisions that are made are often a matter of trade-offs that address the particulars of the application. For example, over-the-road truck engines are necessarily heavy due to particular attention to the function of the engine as a reliable, durable engine that must last over several hundred thousand miles, and be rebuildable.

In a particular embodiment, the goal of the current design activity is to replace the current GA (General Aviation) engines with a piston engine that consumes jet fuel utilizing the diesel cycle. Traditionally diesel engines have used cast iron as a block material due to its high strength, low cost and machine-ability.

The present invention is an engine with a hybrid crankcase including the crankcase being a composite construction having an exoskeleton formed of a non-ferrite material having no defined endurance limit as a material, the non-ferrite exoskeleton encapsulating a load bearing skeleton formed of a ferrite material, the ferrite material having a well defined endurance limit, whereby the skeleton acts to carry the highest engine loadings. The present invention is further a method of forming such an engine.

DETAILED DESCRIPTION OF THE DRAWINGS

Figure 1:
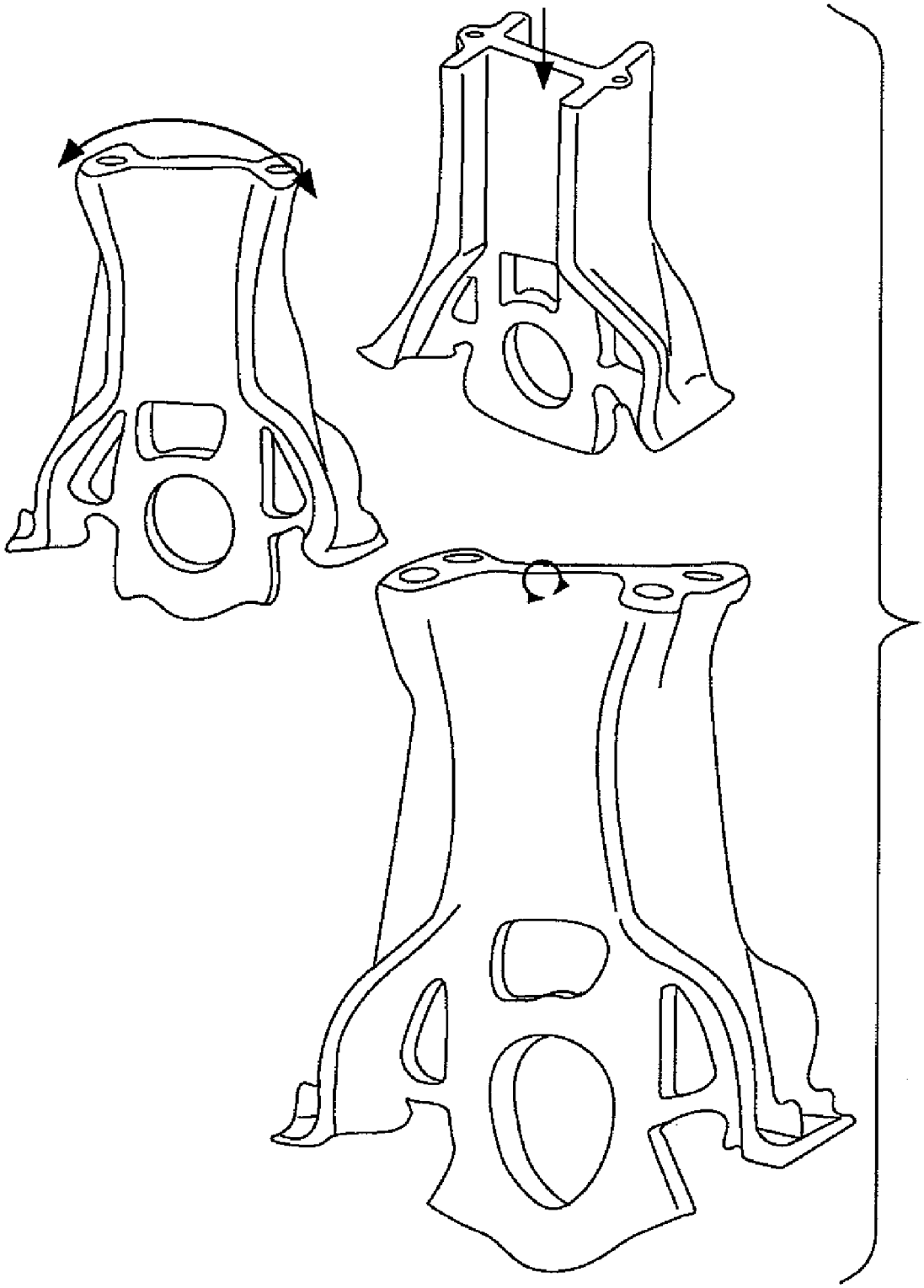
Fig. 1 Prior Art
FIG. 1. is a prior art depiction of typical loads experienced by engine blocks.
Figure 2:
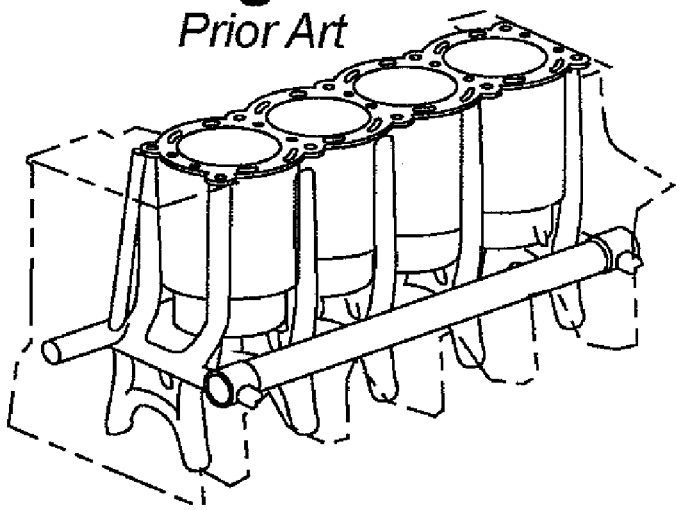
Fig. 2 Prior Art
FIG. 2 is a perspective depiction of the hybrid block of the present invention.
Figure 3:
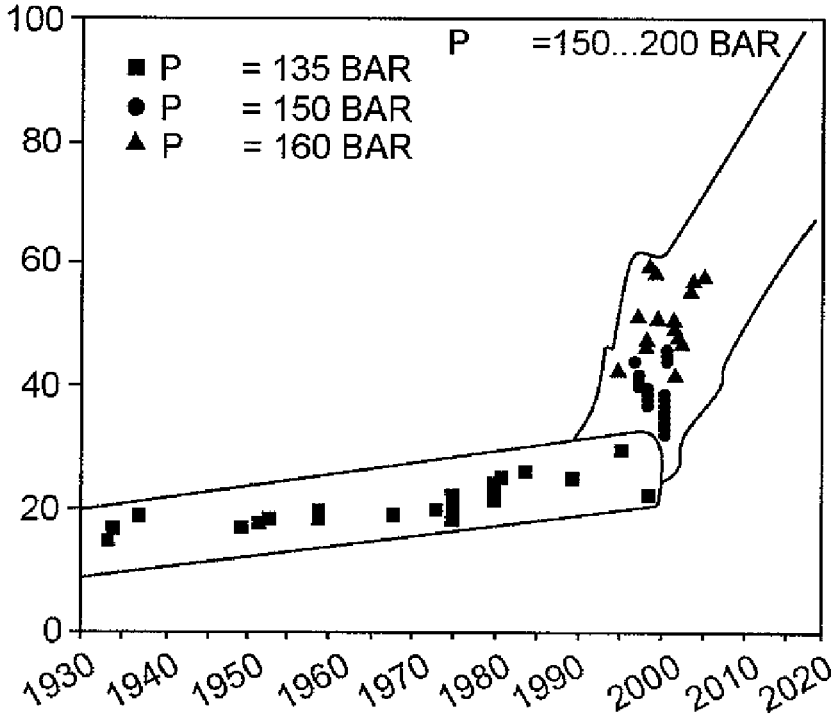
Fig. 3 Prior Art
FIG. 3 is a prior art chart depicting the development of passenger car diesel engines.
Figure 4:
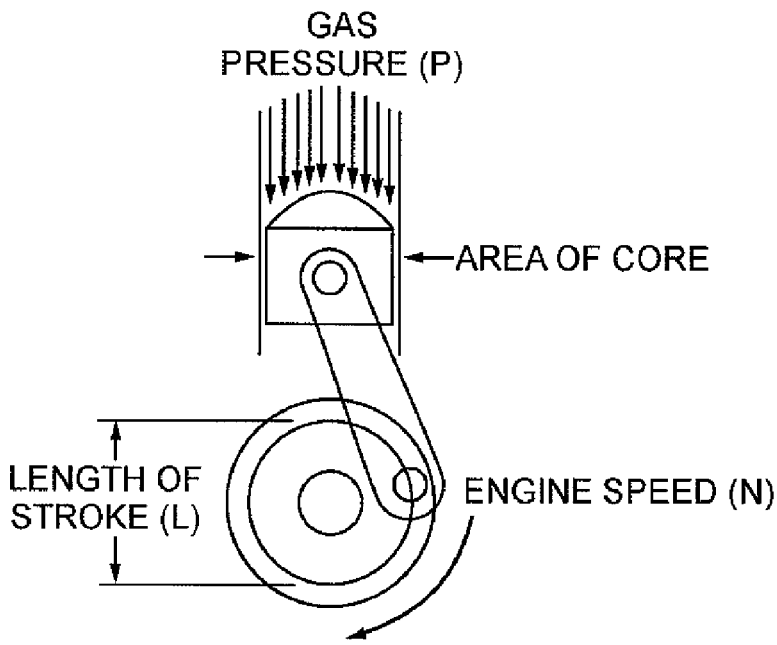
Fig. 4 Prior Art
FIG. 4 is a prior art schematic depiction of the parameters of a combustion engine.
Figure 5:
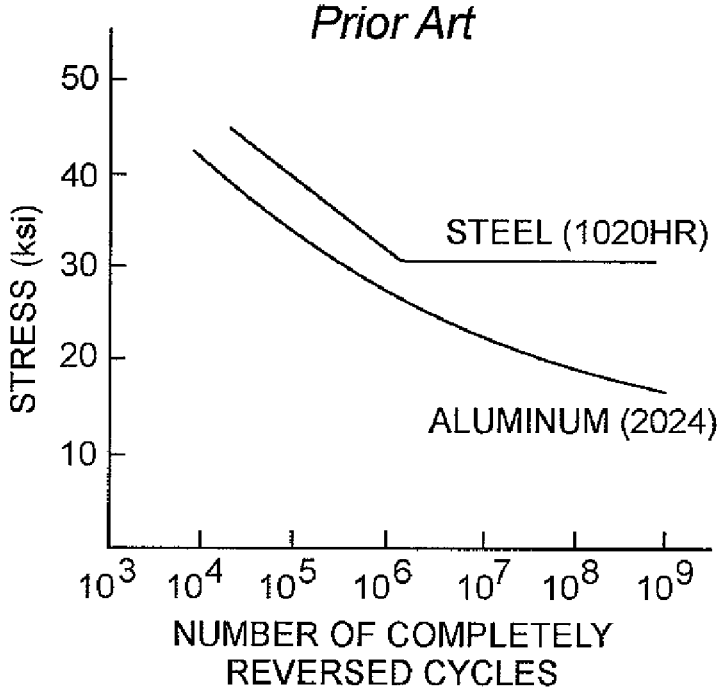
Fig. 5 Prior Art
FIG. 5 is a prior art chart depicting the endurance limit comparison of steel versus aluminum.
Figure 6:
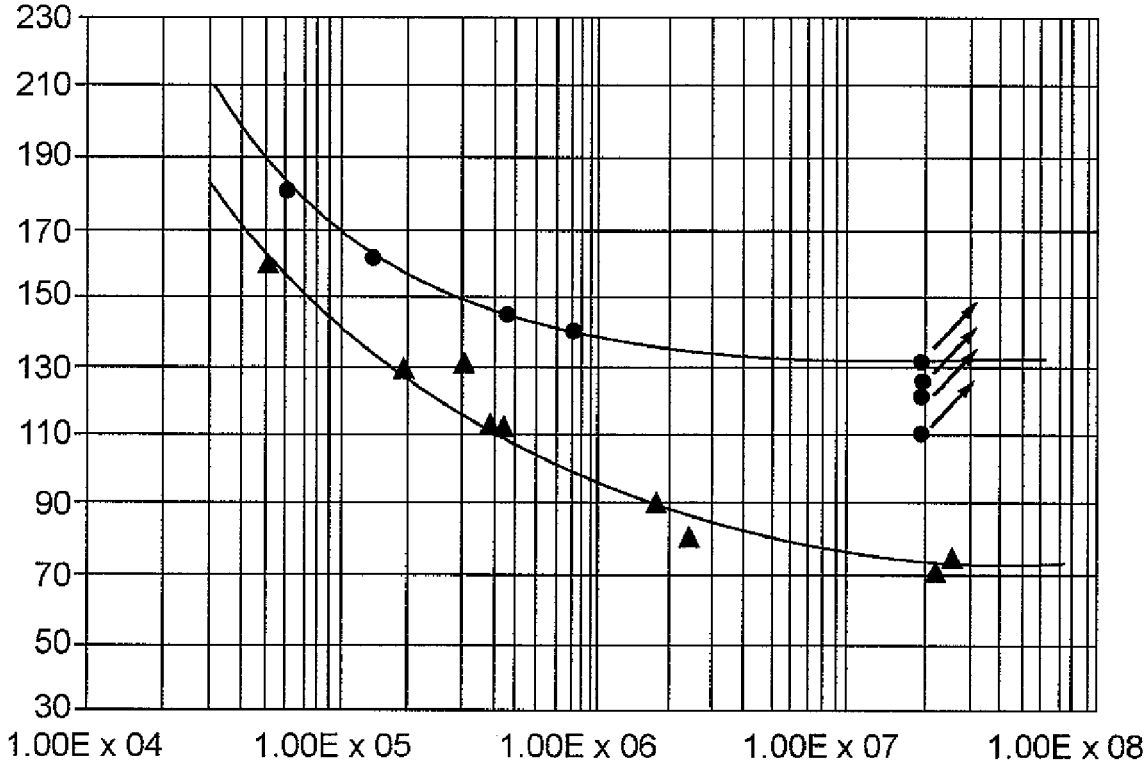
Fig. 6 Prior Art
FIG. 6 is a prior art chart depicting the cooling effect on fatigue strength.
Figure 7:
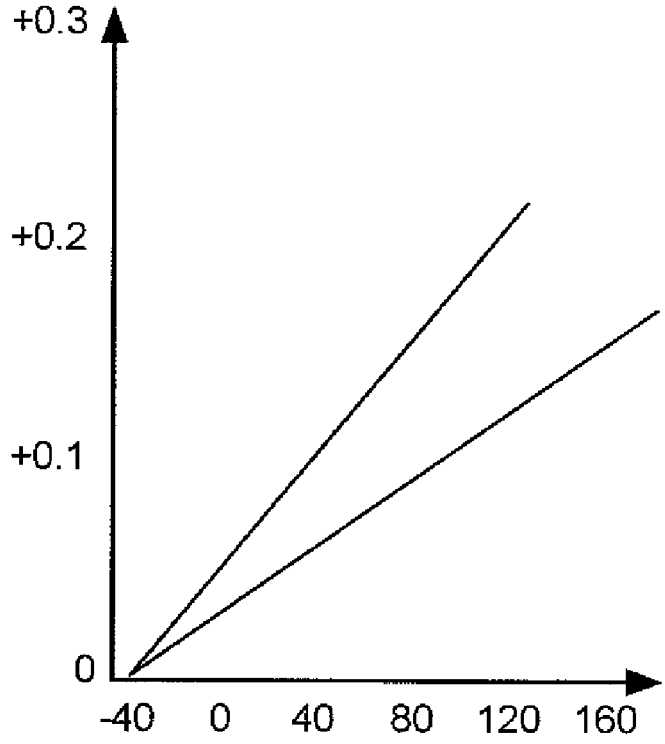
Fig. 7 Prior Art
FIG. 7 is a prior art chart depicting the typical bearing clearance as a function of temperature.
Figure 8:
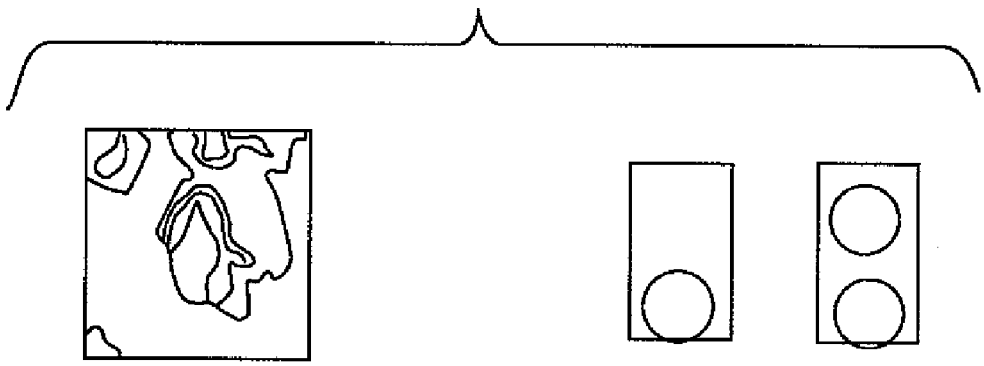
Fig. 8 Prior Art
FIG. 8 is a prior art schematic depicting the areas of fatigue failure in aluminum crankcase structures.
Figure 9:
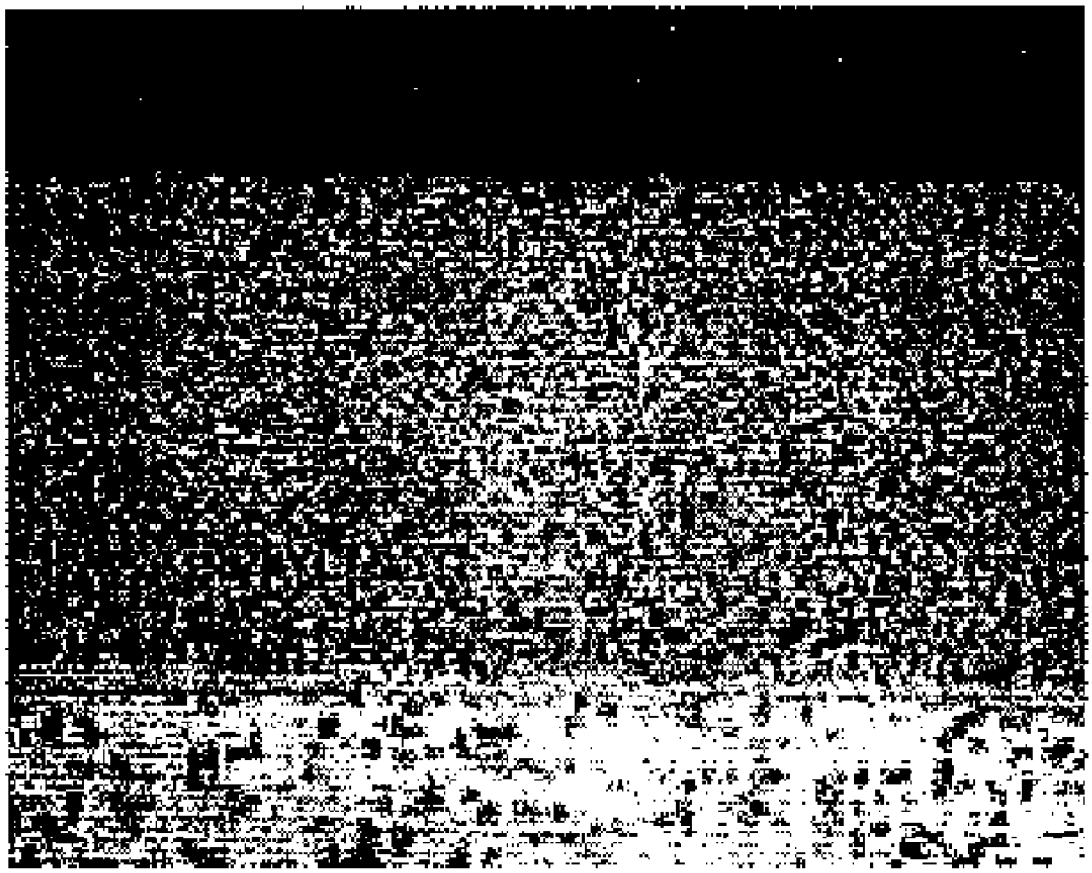
Fig. 9 Prior Art
FIG. 9 is a prior art chart depicting the characteristics of various coatings for aluminum cylinder blocks.
Figure 10:
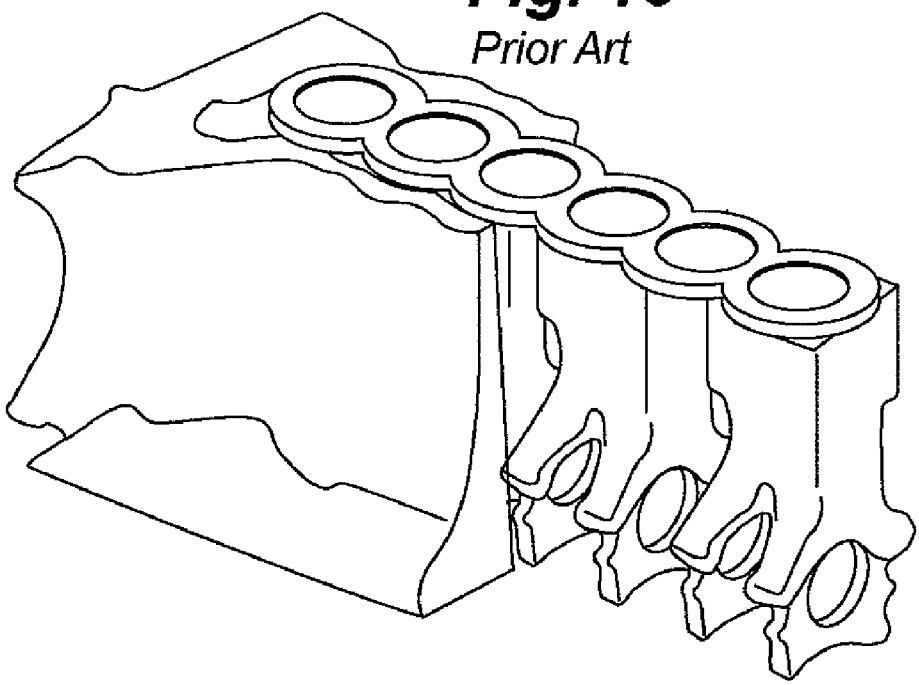
Fig. 10 Prior Art
FIG. 10 is a prior art perspective depiction of a BMW Magnesium/hyper-eutectic Aluminum composite engine block.
Figure 11:
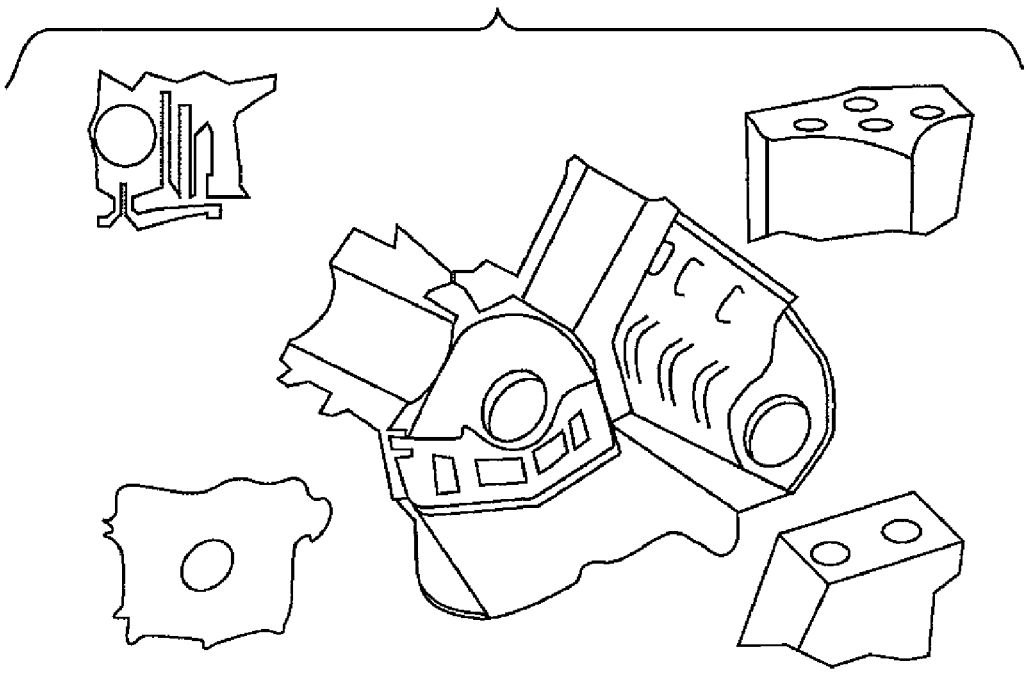
Fig. 11 Prior Art
FIG. 11 is a prior art perspective depiction of steel reinforcement of various sectors in the 4.4 liter BMW aluminum diesel engine.
Figure 12:
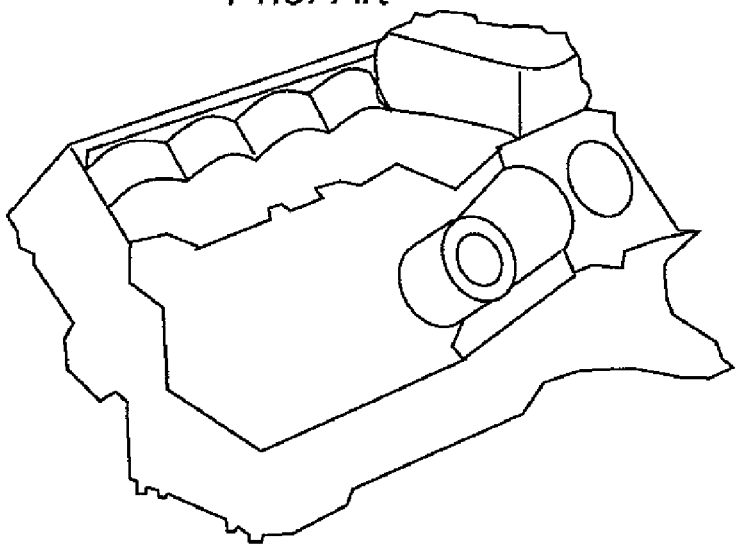
Fig. 12 Prior Art
FIG. 12 is a prior art perspective depiction of an Audi engine block utilizing compacted graphite iron construction.
Figure 13:
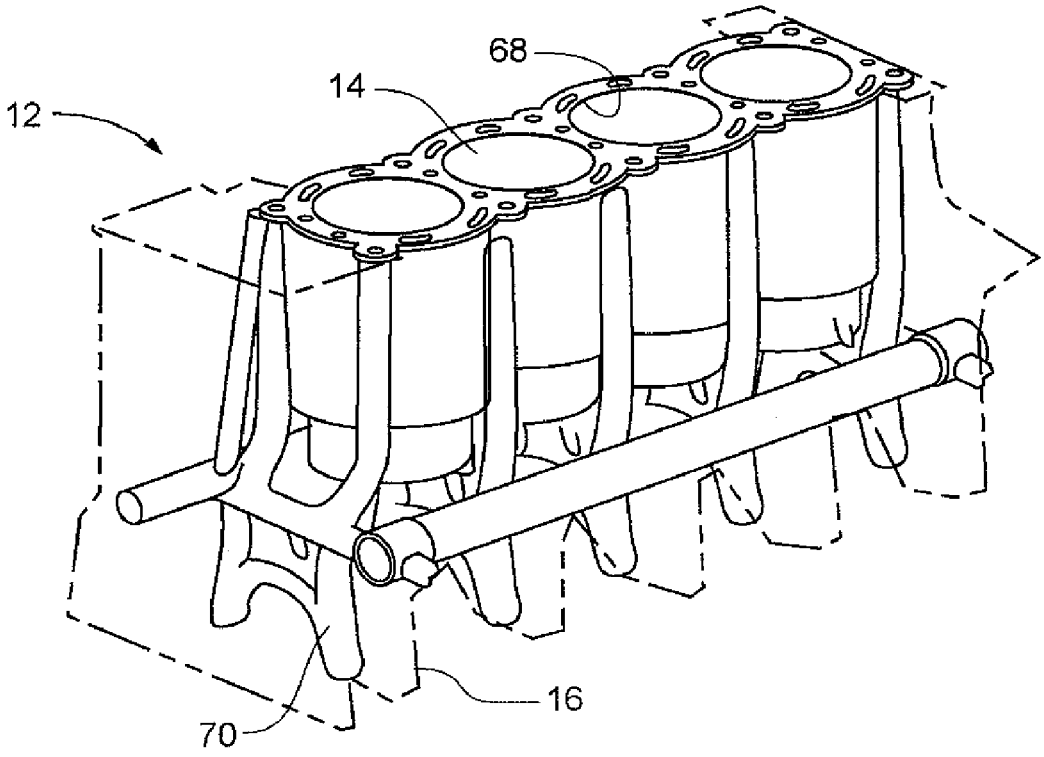
FIG. 13 is a perspective depiction of the pre/post hybrid block casting of the present invention.
Figure 18:
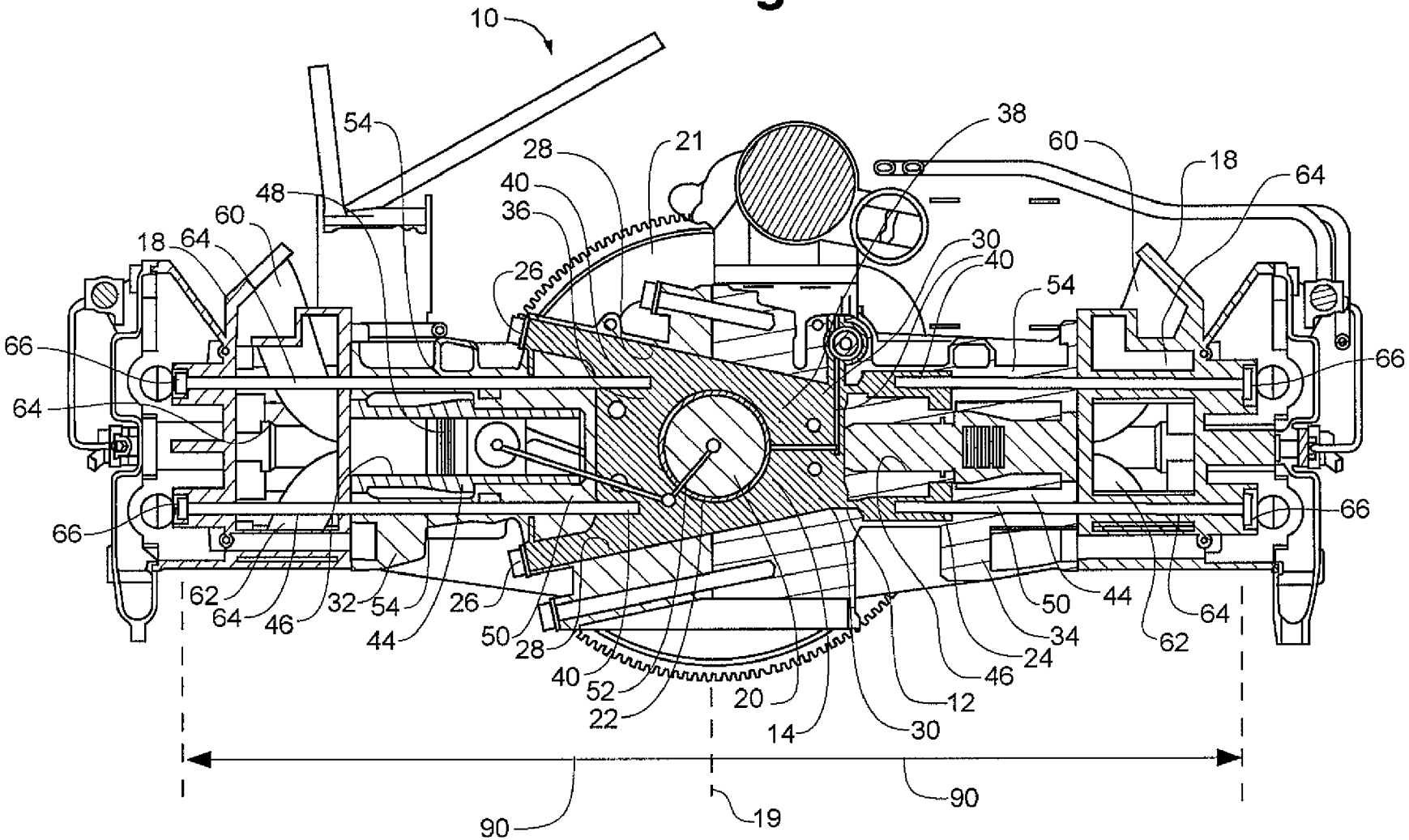
FIG. 18 is an elevational depiction of the force flow diagram in flat-Vee concept of the present invention.

The applicants have designed a different solution to achieve the highest levels of durability and strength in a package suitable for demanding aero applications. The concept relies on the positive attributes of known materials for engine block construction. The design utilizes a pre-cast and post-casting technique which effectively encapsulates ferrite or iron "skeleton 14" within non-ferrite or alloy exoskeleton 16. This concept is depicted in FIGS. 2, 13 and 18.

The engine of the present invention is shown generally at 10 in the figures. The engine 10 has a block 12 comprised of a skeleton 14 formed of a ferritic material and an exoskeleton 16 formed of a non-ferritic material. The engine 10 additionally includes heads 18. Certain ancillary components of the engine 10 are not depicted, such as an oil sump.

The first component of block 12 of the engine 10 is the ferritic skeleton 14. Skeleton 14 is formed of two halves 36, 38 joined at the centerline 19 in vee-type applications. The skeleton 14 supports a crankshaft 20 and a flywheel 21. Skeleton 14 includes a crankshaft bearing 22 rotatably supporting the proximal end of the crankshaft 20. An oil passage 24 is defined in the skeleton half 38 for lubricating the crankshaft 20 and bearing 22. Bolts 26 are disposed in bores 28 defined in skeleton half 36 and threaded into blind threaded bores 30 defined in skeleton half 38. Such bolts not only bolt the two skeleton halves 36, 38 together, but also join the two cylinder banks 32, 34 together compressively. Blind threaded bores 40 are defined in the skeleton 14. Skeleton 14 is formed of a ferritic material.

The second component of block 12 of the engine 10 is the non-ferritic exoskeleton 16. Exoskeleton 16 includes ferritic cylinders 44 with cylinder bores 46 defined therein. A piston 48 is shiftably disposed in the respective cylinder bores 46. The piston 48 is depicted schematically connected to the crankshaft by the connecting rod 50 connected to the crankshaft throw 52. Through bores 54 are defined in the exoskeleton 16. Exoskeleton 16 is formed of a non-ferritic material, preferably an alloy of aluminum or magnesium.

The heads 18 the engine 10 include intake passages 60 and exhaust passages 62 as well as valves (not shown). Through bores 64 are defined in the heads 18. Bolts 66 are passed through the through bores 64, 54 and threaded into threaded bores 40, thereby holding the heads 18 and the exoskeleton 16 in compressive engagement with the skeleton 14. Heads 18 are preferably formed of an alloy of aluminum or magnesium.

Figure 14:
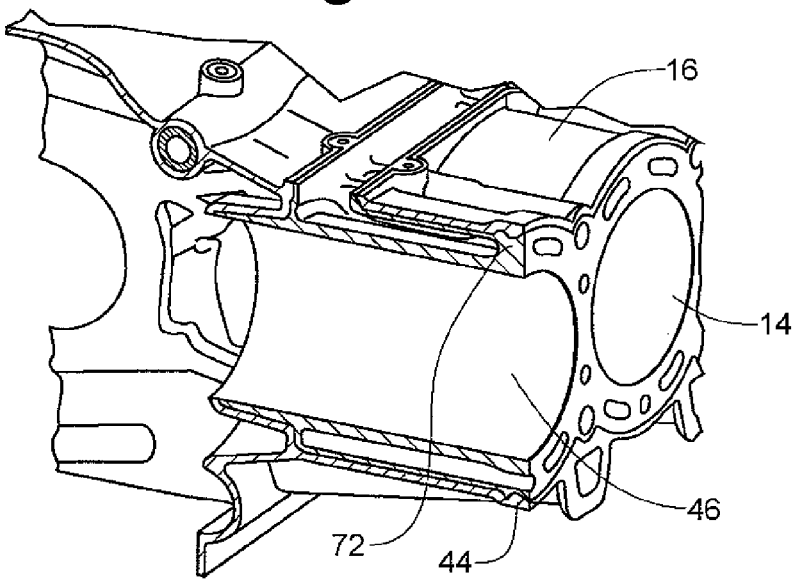
FIG. 14 is a perspective depiction of the locking feature for load distribution of the present invention.
Figure 17:
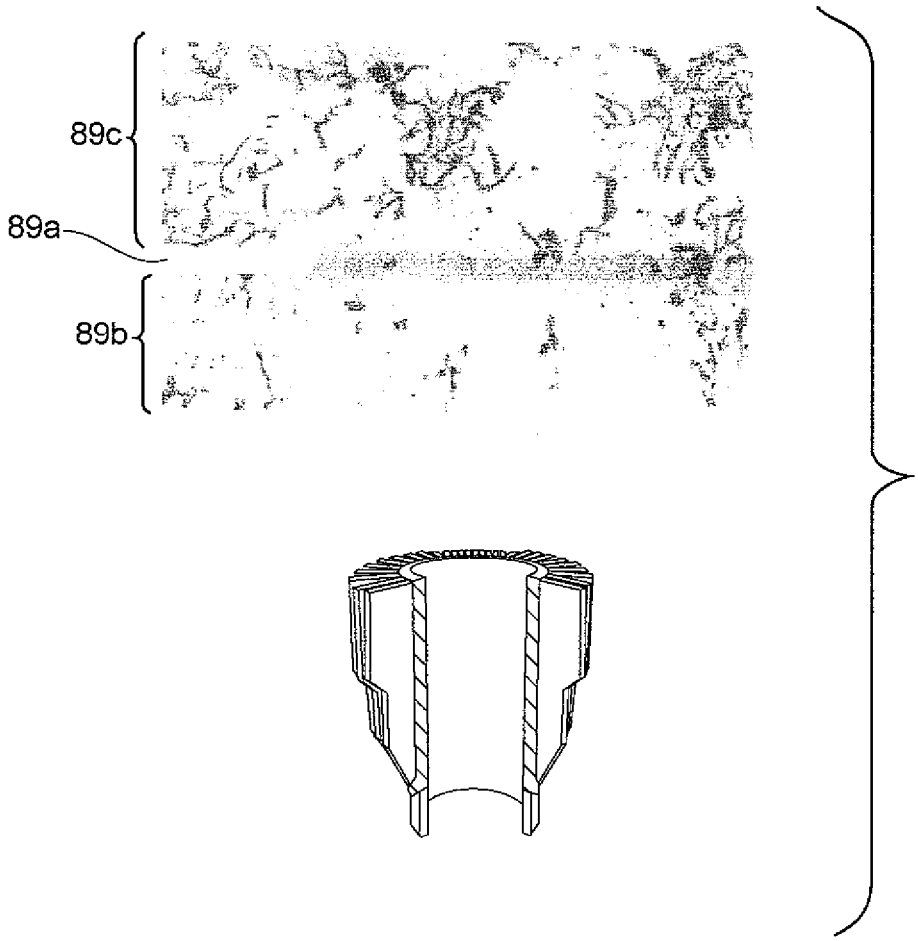
FIG. 17 is a prior art perspective depiction of Alfin® composite cylinder by Mahle.

When examining the construction of the block 12 of the present application, it is not hard to imagine the highest stress areas within the engine "flowing" through the ferritic skeleton 14 of the engine 10. Also, the running surfaces 68 (surfaces that the pistons run in) are formed of iron, which makes the engine 10 renewable per standard "re-boring" procedures. Of particular importance is the main bearing reinforcement area 70 which ensures that the ferritic crankshaft structure 20 is retained within the "iron skeleton 14". (See FIG. 13.) The iron skeleton 14 is cast in a first separate foundry operation. The "iron skeleton 14" is then prepared externally to "bond" to the aluminum 16 by mechanical and chemical means similar to the Mahle Alfin© process (see FIG. 17). The exoskeleton 16 is cast around the skeleton 14. The iron skeleton 14 is dipped into an aluminum/silicon melt before having aluminum material cast around it whereby a so-called alfin layer, consisting of iron aluminides, is formed in a second foundry operation. This alfin layer serves as a binder layer between the iron skeleton and the external shell structure 16. In addition to the "micro-bonding" which is covered in several patents, (i.e. U.S. Pat. No. 5,333,668) the invention integrates secondary "macro" geometric features such as those depicted in FIGS. 14 and 20. The "locking feature 72" depicted in FIG. 14 is effectively implemented as a redundant feature to mechanically "retain" the iron skeleton 14 in the aluminum shell 16. The casting of the exoskeleton 16 flows into a plurality of grooves and niches defined in the skeleton 14 to lock the skeleton 14 and the exoskeleton 16 together.

Figure 15:
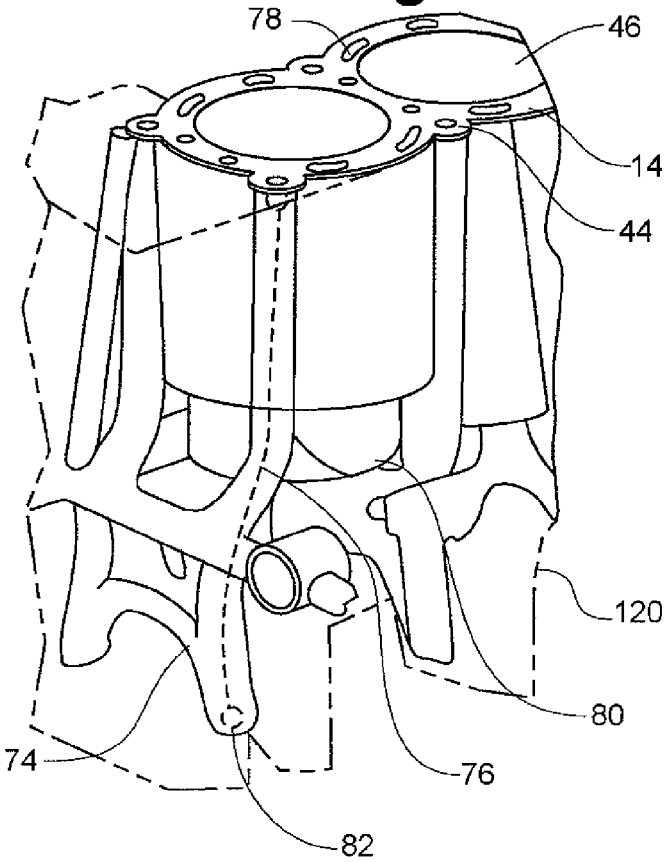
FIG. 15 is a perspective depiction of the stress re-distribution to accommodate cylinder offset in Vee-engines of the present invention.

By using the previously described techniques, the bearing bores 74 and cylinders 44 are constructed of ferritic material or iron, and can be treated as a conventional cast iron engine block with respect to machining. Additionally, bearing clearances are retained at all temperatures, since the thermal expansion rates of the ferritic crankshaft and the ferritic bearing carrier 74 in the composite engine block 12 are identical in this area. Because the two materials (ferritic and non-ferritic) within the composite block 12 construction have different rates of thermal expansion, thermal stress is created as the engine structure is heated or cooled. Since the aluminum has an expansion ratio which is greater than the iron structure, the difference in expansion is accommodated in the design. The thermal stress 70 that is present due to normal engine heating is effectively "shared" in mechanical series by the locking feature 72 that imparts the thermal load existent in the aluminum exoskeleton 16 to the iron skeleton 14. (See FIGS. 14 and 15).

As the load path from the cylinder deck 78 to the main bearing 74 is traversed, it can be seen (see FIG. 15) that the skeleton structure is the most effective way to deal with the necessary "bank-bank offset" in vee-engines that results when using connecting rods that share a common throw, as per usual American vee-eight practice. By utilizing the length 80 between the deck 78 and main bearing split 82, any "re-distribution" of stress is not "focused" in a very small area, which would amplify the stress. This feature is more practical when the engine is a long-stroke engine, as is prevalent in diesel engines. This ensures a structurally stable block, which makes use of the entire volume of engine block material for stress distribution.

Within the hybrid block 12 construction, the mass of aluminum exoskeleton 14 that encapsulates the iron skeleton 16 is useful for:

- Re-distribution of structural stress by mechanical interlocking of the two elements.
- Controlling the local temperature of the engine structure by thermal re-distribution utilizing the highly thermal conductive properties of aluminum, magnesium or other alloy. The thermal conduction of aluminum is well known. Anyone that has welded it has experienced first-hand the ability of the material to transmit heat within the structure and to act as a general heat sink.
- Exposing the "return oil" to the external engine skin for enhanced cooling of the oil.
- Superior damping of the diesel engine acoustics by using the superior cast-ability of the aluminum material to create intricate ribs for local strength enhancement. These ribs can be integrated in engine features such as the oil return passages depicted in FIG. 16, or generalized structures. Sound damping is generally achieved when a structure is comprised of areas that have different local stiffness. As a general statement, a higher strength/weight ratio of any mechanical structure will push its resonant frequency higher, and hopefully out of the range which can be excited by combustion events.

The external shape and structure of the engine block is the focus of much work today. As the diesel engines become more prevalent, there has been a lot of effort to eliminate some of the un-desirable noise that was associated with diesels in the past. The extreme rise in pressure has been the source of a tremendous amount of diesel "noise". Many achievements have been made with the utilization of high-pressure electronic fuel injection to increase diesel engine efficiency and reduce structure borne noise by "shaping" the pressure rise in the engine. Engine noise transmission can be minimized at the source by integrating engine features which make the block locally stiff.

Figure 16:
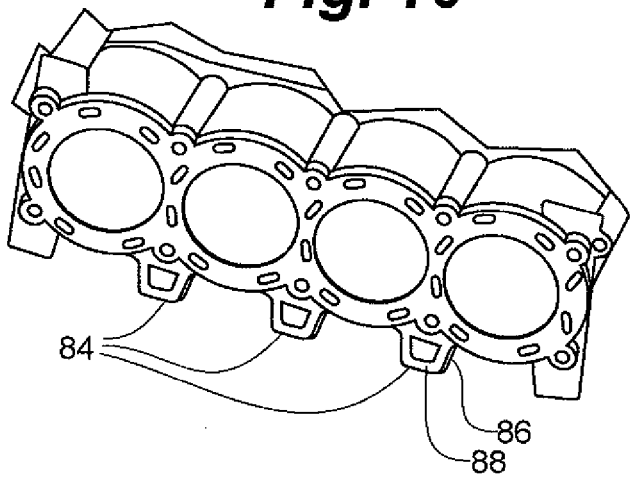
FIG. 16 is a perspective depiction of structural reinforcement of the engine with exoskeletal oil drain back feature of the present invention.

To this end, a unique way is to make the external structure heavily reinforced by using necessary engine features that must be included in the design in any event. FIG. 16 is a depiction of how the present invention effectively uses the oil drain back feature from the cylinder head to enhance the stiffness of the engine block 12. In this case, the oversize oil return tubes 84 ensures proper oil return to the outermost "skin" 86 of the engine, and dramatically reinforces the engine 10 structure. As can bee seen the wall thickness 88 of the tubes 84 is substantially greater than is otherwise necessary to convey low pressure oil.

The practical features which must be considered when casting a "composite" block 12 must be considered on several different levels. On the microscopic level, the present invention creates a bonding layer 89*a* that is comprised of an iron-aluminum coating which has been traditionally applied by companies such as Mahle to form a true inter-metallic bonding between the light alloy 89*b* and the cast iron skeletal structure 89*c*. These cylinder assemblies have been referred to as Alfin® cylinder by Mahle and are shown in Prior Art FIG. 17.

In addition to the "microscopic" processes noted above used to bond the structures in a composite block, there are several macroscopic effects that are utilized in the present invention to create a mechanical "lock" between the skeleton 14 and the exoskeleton 16, which can be used to:

1. Reduce the effects of thermally induced stress along the major engine dimensions.
2. To create a feature such as a v-groove 72 that ensures load sharing between the internal and external casting structures. (See FIG. 14)
3. To separate functionality between the internal casting of the skeleton 14 and external casting of the exoskeleton 16. (i.e. the sealing of high pressure versus low pressure functions)
4. To stabilize the major dimensions that control engine functionality. (i.e. bearing function and bore dimensions)

With the use of two or more materials to form block 12, the combination of results can be tailored to achieve results that would not be possible in using a single material in the block component.

With respect to the first macroscopic effect noted above, the engine 10 configuration which makes the best use of the material that is required to sustain the power transmission function of the engine 10 must be considered. In its simplest form, the function of the engine block 12 is to act as a collection of pressure vessels, each used in conjunction with a crank-rocker mechanism to convert gas expansion into useful work.

In weight-sensitive applications the goal is to make sure that there is no un-necessary material in the engine structure. That is, the present invention uses highest strength (generally more dense) material in areas that see a high degree of alternating loading i.e., the skeleton 14. The use of materials that have defined endurance limit and thus favorable fatigue properties such as various forms of cast iron is preferred. Other materials such as aluminum, magnesium or other alloys are then used to form the exoskeleton 16. The most likely materials are those that are easily cast and have a desirable heat transfer and strength/weight ratios. (Preferably aluminum) to define the external (less directly loaded) exoskeleton 16 of the block 12. This ensures the structure of the block 12 is optimized for weight and long service life.

Examination of horizontally opposed cylinder configurations (180-degree vee, boxer, inline) indicates that there is an opportunity to save weight with the concept. The advantage becomes apparent when a simple force-flow diagram is constructed of the 180-degree, vee-engine. This diagram is depicted in FIG. 18. Note that the arrows 90 indicate thermal loading puts the material of the exoskeleton 16 and heads 18 in compression.

However, the principles can be readily applied to other common engine forms such as in-line or boxer configurations. The basic presumption is that the difference in the material thermal expansion between the skeleton 14 and exoskeleton 16 is used for the benefit or retaining the structure in such as way that the material of the exoskeleton 16 is kept within the compressive region. The area directly under the head bolts 66 to the engine center 19 constrains the aluminum exo-skeleton 16 of the engine block 12. Since the exoskeleton 16 is comprised of aluminum which has a higher thermal expansion ratio than the iron skeleton 14, it must be constrained by the internal features of the skeleton 14. Thus the head bolts 66 experience an added thermal stress when the engine heats. By the nature of the iron material, these bolts 66 can be designed to carry this thermal load, as well as the inertial and fluctuating gas loads to an "infinite design life". The stress of the exoskeleton 16 structure of the engine 10 is generally distributed better, due to the larger geometry, and larger volume of material forming the exoskeleton 16.

From a Strength of Materials perspective, the sensitivity to fatigue is related to the type of part loading. This principle is evident in the process known as shot-peening, which is widely used to create a compressive zone on the surface of highly loaded parts such as connecting rods. By creating a local region of compressive stress, the part can be loaded more severely without exceeding the elastic region. The concept shown in FIG. 18 causes the entire aluminum exoskeleton 16 structure (and part of the cylinder head under the head bolts 66) to be held in compression, before it is elongated by the gas firing forces. By doing this, the loading is such that the fatigue stress is minimized, and the susceptibility of fatigue in the aluminum exoskeleton 16 is reduced.

One can see upon closer examination of FIG. 18, that the majority of the alternating load is carried in the skeleton 14 potion of the structure or the block 12, which is generally conceived to be cast iron, or a mechanically equivalent material of high endurance limit. The surrounding exoskeleton 16 structure can then be of a light-weight material such as aluminum alloy, or magnesium. A general feature of this type of construction is that the "alloy" portion is generally loaded in compression, due to the difference in thermal expansion of the two materials.

Additionally, the main bearings are captivated in a "vertically-split" crankcase. This is done to ensure that the loads on the retaining bolts 66 are generally perpendicular to the split line 19. The alternate banks 32, 34 of the engine 10 utilize the same central area of the engine "ladder frame" formed by the skeleton 14 to support the crankshaft 20 loading and sustain the cylinder head. This ensures that the load is carried by a dedicated area of high endurance limit material. The length 76 between the deck and main bearing split. It should be noted that the ferritic portion 14 is wedge shaped to allow the two engine halves 36, 38 to be assembled with the V-shaped 4-bolt mains. This feature is unique to the design of the engine 10.

Another desirable feature of this type of construction is that the engine 10 of FIG. 18 has excellent thermal stability. That is, the bearing carrier and crankshaft 20 are both constructed of a ferritic material to ensure similar thermal growth, and consistent bearing clearances. This feature assures consistent oil film thickness in both cold and hot start environments, thus minimizing any damage that might occur in the absence of a sufficient oil film. This can be particularly critical when the engine is used intermittently, as in aircraft or marine applications.

Figure 19:
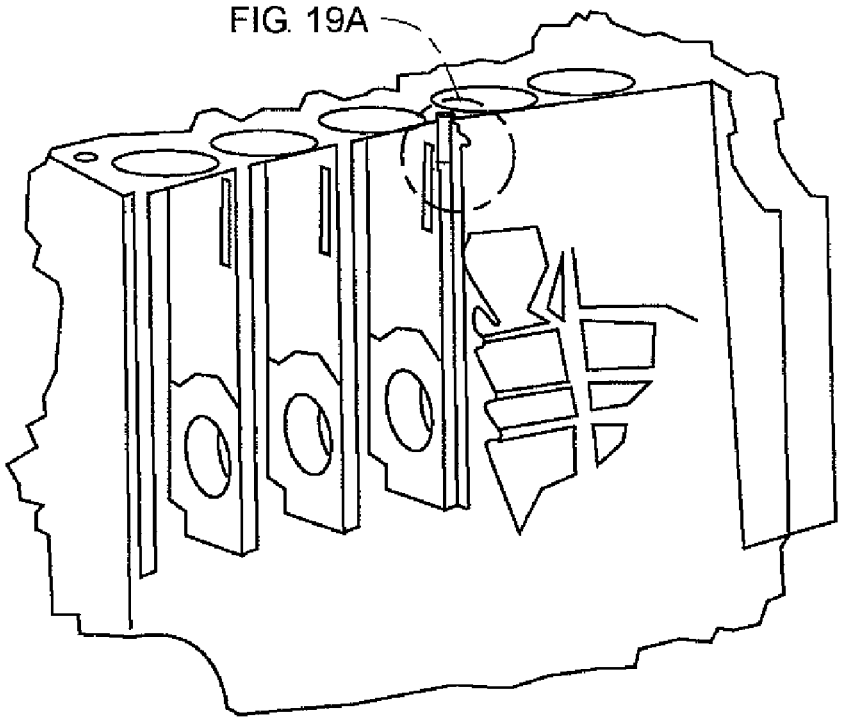
FIG. 19 is a prior art depiction of the VW five cylinder Aluminum diesel with iron bearing retainers.
Figure 19A:
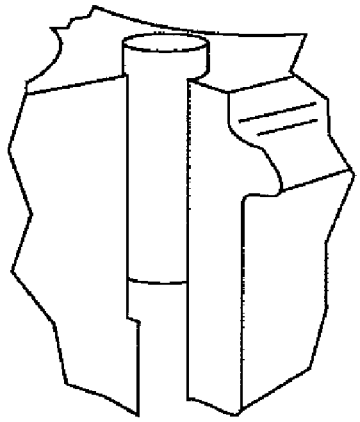

With respect to the second of the macroscopic effects noted above, the 10 engine of the present invention is sealed at the junctions that are highest loaded. This is different from the design of other manufacturers. For example, a hybrid carrier construction has been used to retain the engine main bearings in a ferritic structure by Volkswagen. This design relies on long attachment studs, such as those seen in Prior Art FIG. 19.

Figure 20:
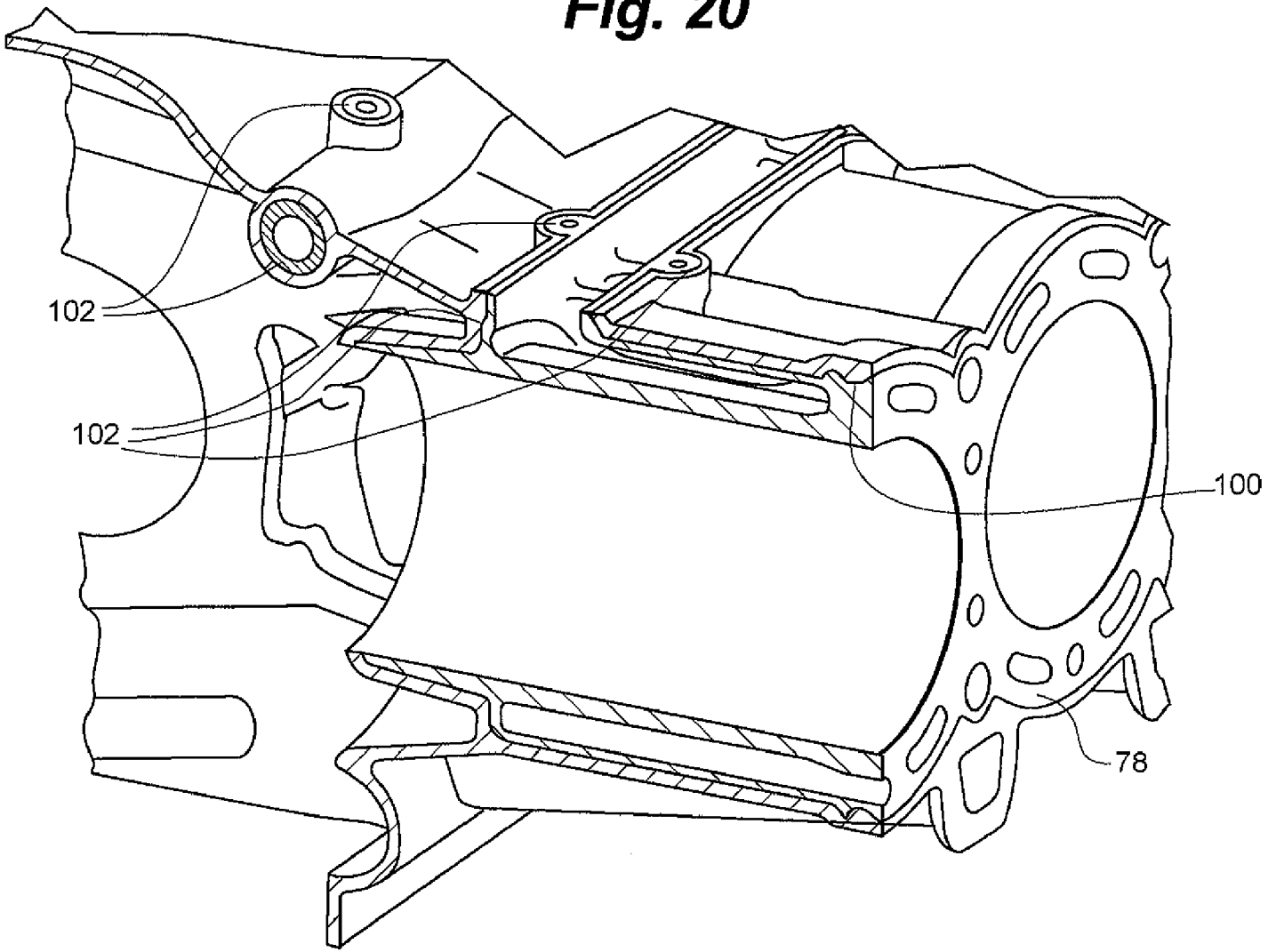
FIG. 20 is a perspective depiction of the high-pressure, sealing areas in cast iron for joint stability feature of the present invention.

The design of the present invention is practically different, since it utilizes proportionally more iron structure to include such features as:

- Re-buildable bores in iron; which is important to aviation consumers
- The water jacket is included in the ferritic skeleton 14 sub-casting, while the alloy exoskeleton 16 contains the oil passages, so oil-water leakage is not possible
- Retention of cylinder heads in the ferritic structure of the skeleton 14
- Inclusion of main bearing feeds in the skeleton 14 sub-casting for all temperature operation by flowing the oil within the iron skeletal 14 structure close to the main bearing carriers, ensures that the main bearings have sufficient pressure, and stabilize quickly in low-temperature service
- Sealing land 104 integrated in sub-casting (See FIG. 20)
- Interlocking features to ensure accurate positioning of sub-casting and reduction of structure born noise emissions These construction features are depicted in FIG. 20.

Figure 21:
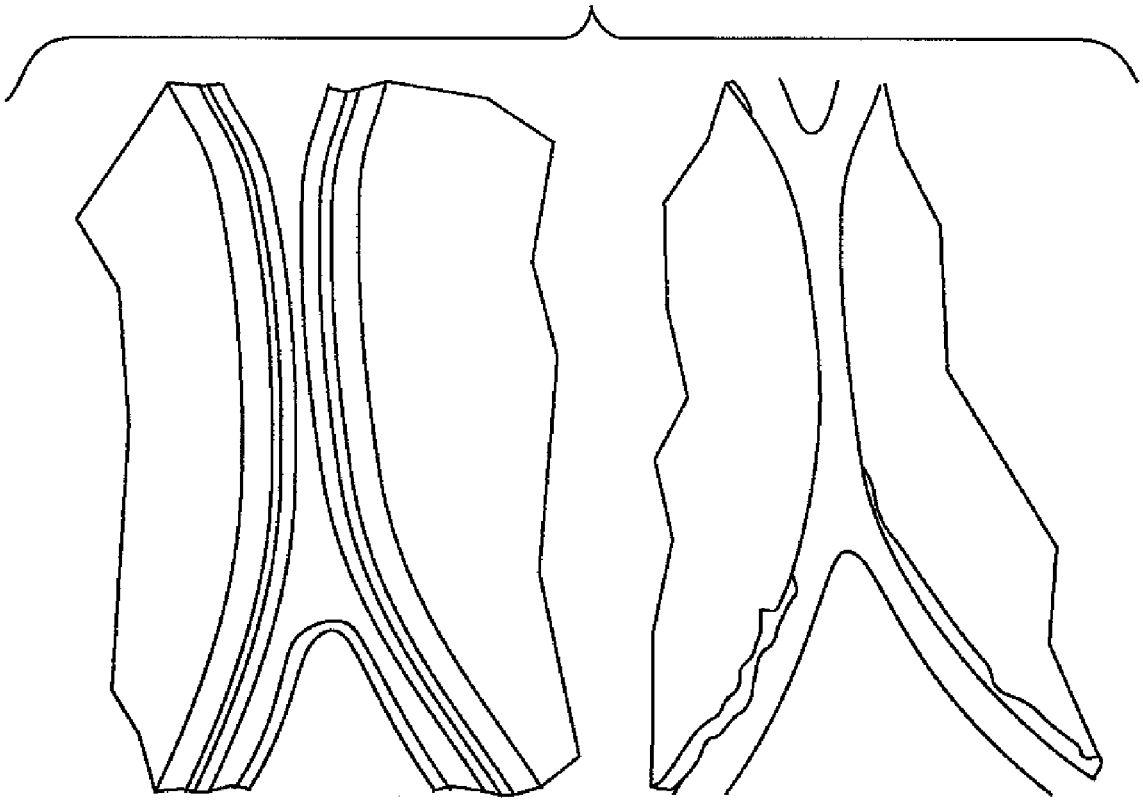
FIG. 21 is a prior art planform depiction of an example of a steel beaded cylinder head gasket.

The present invention construction utilizes a v-groove 100 near the cylinder deck 78 for a couple of very practical reasons. The first is that the thermal stress is effectively "contained" or focused in the material toward the bearing bore, rather than causing a local disturbance near the cylinder head joint at cylinder deck 78. With a very stable inter-cylinder area, it is possible to use a modern steel beaded gasket (See FIG. 21), while maintaining close bore-bore spacing without distoring the cylinder bores.

Additional groove or locking features 102 are placed at various heights ranging from the main bearing centers to the deck. The location depends on the control the designer wants to have on local distortion and the load sharing characteristic between the inner and outer castings.

Figure 22:
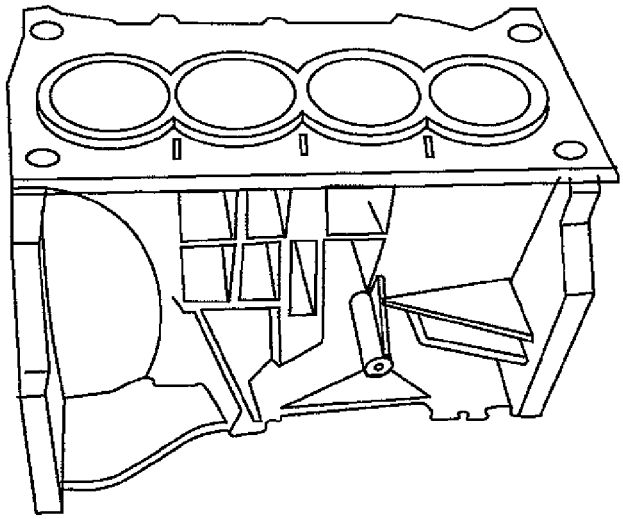
FIG. 22 is an elevational prior art depiction of Nissan's execution of cross-flow cooling in an open deck design.
Figure 23:
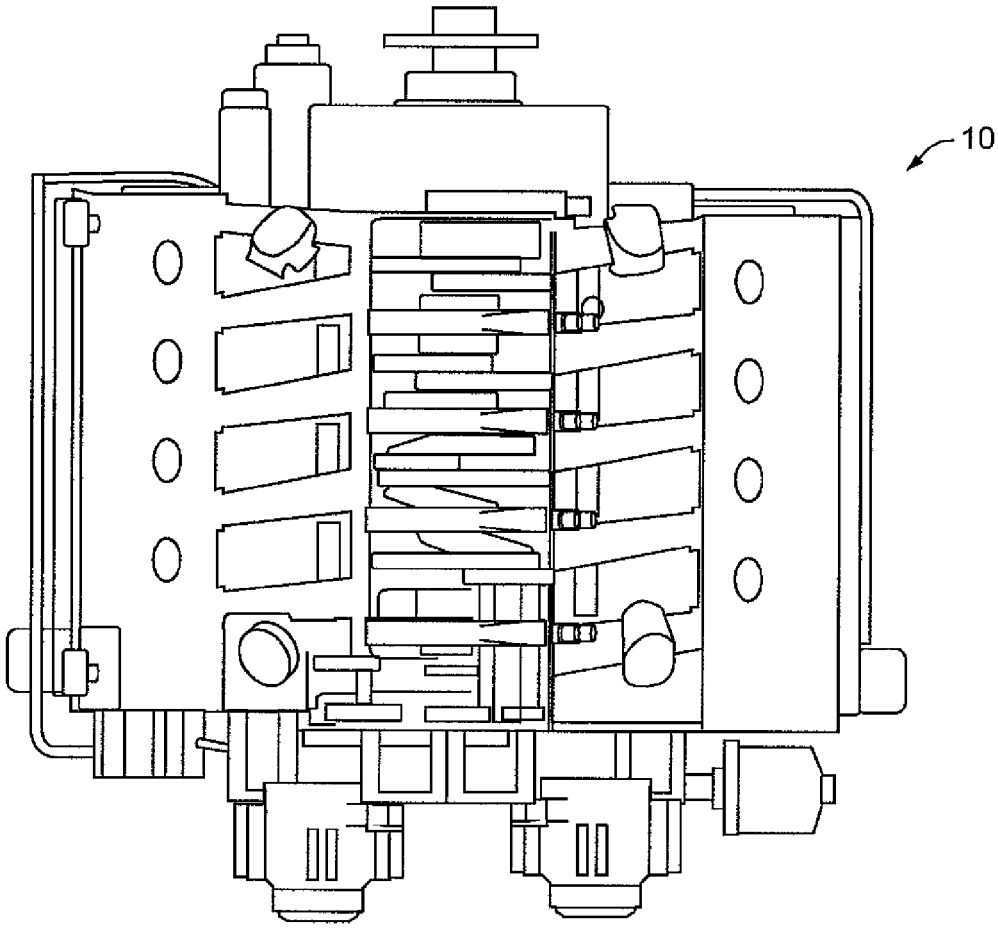
FIG. 23 is a planform depiction of the engine of FIG. 18.

When close cylinder bore spacing is utilized, there is no provision for a cross-flow cooling system which can be used to carefully control cylinder bore distortion. In the case of the close deck concept of engine 10 as depicted in FIG. 20, a feature such as used by Nissan (See Prior Art FIG. 22) may be considered to minimize bore distortion due to thermal expansion. With a cast iron material, a portion of coolant may pass in the deck area without fear of coolant leakage into the cylinder bore area.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

The invention claimed is:

1. An engine with a hybrid crankcase, the crankcase being a composite construction having an exoskeleton formed of a non-ferrite material having no defined endurance limit as a material, the non-ferrite exoskeleton encapsulating a load bearing skeleton formed of a ferrite material, the ferrite material having a well defined endurance limit, whereby the skeleton acts to carry the highest engine loadings, the exoskeleton being formed with a plurality of intricate ribs, the ribs acting to strengthen the engine block structure while enhancing the acoustic signature.

2. The engine of claim 1, the exoskeleton being formed of an aluminum or magnesium alloy.

3. The engine of claim 1, all highly loaded connections, including for main bearing caps and cylinder stud locations, being terminated in the skeleton.

4. The engine of claim 1, the exoskeleton being formed of high thermal conductivity material for dispersing local thermal loads and for being used to sink heat as a thermal battery in adverse cooling situations.

5. The engine of claim 1, including oil drain backs being integrated in the exoskeleton, the oil drain backs providing a cooling feature by passing the oil near a external, high-surface area, of the exoskeleton, whereby the oil drain acts as a functional enhancement to oil cooling, while aiding in engine oil supply circulation.

6. The engine of claim 1, having a coolant circuit defined within the skeleton and a lubrication circuit defined in the skeleton, thereby separating the coolant circuit and the lubrication circuit to minimize cross-leakage which could contaminate either circuit.

7. The engine of claim 1, including integrating a coolant jacket in the skeleton, thereby stabilizing bore dimensions and reducing engine friction and incorporating a local high-pressure sealing land therein having the strength to be able to function with the highest pressure diesel combustion.

8. The engine of claim 1, the skeleton being re-borable per usual practice, thereby allowing the engine to have a service life past the initial design point.

9. The engine of claim 1, the duality of the non-ferrite and the ferrite structure acting to minimize structure borne noise.

10. The engine of claim 1, employing a pre-post casting process for bonding the exoskeleton and skeleton structures on both a microscopic and macroscopic level.

11. The engine of claim 10, the macroscopic features being placed in such a manner as to "focus" thermally induced stress, and ensure a shared load between exoskeleton and skeleton structure castings.

12. The engine of claim 1, wherein the mismatch of thermal expansion coefficients between the exoskeleton and skeleton structures maintains the exoskeleton structure in a thermally induced compressive state during engine operation, thereby ensuring a superior fatigue performance for the exoskeleton structure, which, structure does not have a defined endurance limit.

13. The engine of claim 1, the skeleton structure providing a load path that promotes stress distribution within the largest mass of the engine block as a function of a length dimension and a mechanical locking feature.

14. The engine of claim 1, the thermal conductivity of the exoskeleton being used to enhance the local properties of the skeleton structure by placing less demand on cooling system accuracy by effectively having a heat load redistribution system built into the block structure, thereby minimizing the degradation of material properties with temperature to reduce engine weight.

15. A method of forming an engine with a hybrid crankcase, including forming the crankcase of a composite construction having an exoskeleton formed of a non-ferrite material having no defined endurance limit as a material, encapsulating a load bearing skeleton formed of a ferrite material, the ferrite material having a well defined endurance limit, and to carrying the highest engine loadings by means of the skeleton, defining a coolant circuit within the skeleton and defining a lubrication circuit in the skeleton, thereby separating the coolant circuit and the lubrication circuit to minimize cross-leakage which could contaminate either circuit.

16. The method of claim 15, including forming the exoskeleton of an aluminum or magnesium alloy.

17. The method of claim 15, including terminating all highly loaded connections, including for main bearing caps and cylinder stud locations, in the skeleton.

18. The method of claim 15, including forming the exoskeleton of high thermal conductivity material for dispersing local thermal loads and for being used to sink heat as a thermal battery in adverse cooling situations.

* * * * *